US009936727B2

(12) United States Patent
Polloni et al.

(10) Patent No.: US 9,936,727 B2
(45) Date of Patent: Apr. 10, 2018

(54) FILTER-TIPPED CIGARETTE WITH A REMOVABLE CAP, AND RELATIVE MANUFACTURING METHOD AND MACHINE

(71) Applicant: G.D SOCIETA' PER AZIONI, Bologna (IT)

(72) Inventors: Roberto Polloni, Modigliana (IT); Marco Ghini, Monte San Pietro (IT); Ivan Eusepi, Castelmaggiore (IT); Stefano Negrini, Calderara di Reno (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 559 days.

(21) Appl. No.: 14/402,381

(22) PCT Filed: May 28, 2013

(86) PCT No.: PCT/IB2013/054413
§ 371 (c)(1),
(2) Date: Nov. 20, 2014

(87) PCT Pub. No.: WO2013/179228
PCT Pub. Date: Dec. 5, 2013

(65) Prior Publication Data

US 2015/0090274 A1 Apr. 2, 2015

(30) Foreign Application Priority Data

May 28, 2012 (IT) ..... BO2012A0291

(51) Int. Cl.
*A24D 1/04* (2006.01)
*A24D 1/02* (2006.01)
(Continued)

(52) U.S. Cl.
CPC ..... *A24D 1/04* (2013.01); *A24C 5/10* (2013.01); *A24C 5/47* (2013.01); *A24C 5/586* (2013.01); *A24D 1/00* (2013.01); *A24D 1/02* (2013.01)

(58) Field of Classification Search
CPC ..... A24D 1/04; A24C 5/10; A24C 6/47
See application file for complete search history.

(56) References Cited

U.S. PATENT DOCUMENTS 5,074,321 A * 12/1991 Gentry ..... A24B 15/14 131/335
2015/0289566 A1* 10/2015 Carraro ..... A24D 3/0287 131/281
2015/0296882 A1* 10/2015 Mironov ..... A24C 5/54 131/330

FOREIGN PATENT DOCUMENTS

DE 360358 C 10/1922
GB 810759 A 3/1959
(Continued)

OTHER PUBLICATIONS

International Search Report with regard to International Application No. PCT/IB2013/054413, dated Oct. 28, 2013.

*Primary Examiner* — Anthony Calandra
(74) *Attorney, Agent, or Firm* — Marshall, Gerstein & Borun LLP

(57) ABSTRACT

A filter-tipped cigarette having: a tobacco portion having an outer end and an inner end; a filter butt-connected to the inner end of the tobacco portion; a first sleeve wound about the tobacco portion and the filter to connect the filter permanently and non-detachably to the tobacco portion; a cap butt-connected to the outer end of the tobacco portion, at the opposite end from the filter, and removable to smoke the filter-tipped cigarette; and a second sleeve, which is wound about the cap and the tobacco portion, is integral with
(Continued)

the cap, and is at least partly removable axially from the tobacco portion together with and to remove the cap.

17 Claims, 15 Drawing Sheets

(51) Int. Cl.

| | |
|---|---|
| ***A24D 1/00*** | (2006.01) |
| ***A24C 5/10*** | (2006.01) |
| ***A24C 5/47*** | (2006.01) |
| ***A24C 5/58*** | (2006.01) |

(56) References Cited

FOREIGN PATENT DOCUMENTS

| | | | |
|---|---|---|---|
| GB | 2284339 | A | 6/1995 |
| WO | WO-2007/051163 | A2 | 5/2007 |
| WO | WO-2008/059201 | A1 | 5/2008 |
| WO | WO-2009/007258 | A1 | 1/2009 |

* cited by examiner 7
2
5
6
8

7
2
5
6
8

7
2
5
6
8

7
2
5
6
8

7
2
5
6
8
13

7
2
6
13
8

FILTER-TIPPED CIGARETTE WITH A REMOVABLE CAP, AND RELATIVE MANUFACTURING METHOD AND MACHINE

CROSS-REFERENCE TO RELATED APPLICATIONS

This application is the U.S. national phase of PCT/IB2013/054413, filed May 28, 2013, which claims the benefit of Italian Patent Application No. BO2012A000291, filed May 28, 2012.

TECHNICAL FIELD

The present invention relates to a filter-tipped cigarette and relative manufacturing method and machine.

BACKGROUND ART

A filter-tipped cigarette comprises a tobacco portion having an outer end and an inner end; and a filter butt-connected to the inner end of the tobacco portion and connected to the tobacco portion by a sleeve wound about the filter and partly about the tobacco portion. The outer end of the tobacco portion is free (i.e. the tobacco is left exposed), constitutes the tip of the filter-tipped cigarette, and is used by the user to light the filter-tipped cigarette.

A good-quality filter-tipped cigarette must be filled firmly, i.e. contain a sufficient amount of tobacco, at the tip. Conversely, a filter-tipped cigarette with an 'empty' tip, i.e. containing no tobacco, is considered poor quality. By the end of the manufacturing process, almost all filter-tipped cigarettes have perfectly filled tips, but the mechanical stress they are subjected to during subsequent transfer and packing may result in tobacco fallout from the tips. So, after forming and before wrapping each group of filter-tipped cigarettes, the tips are quality controlled optically, and the group is rejected if even only one of the filter-tipped cigarettes in it has a poorly filled tip (in other words, since a standard group of filter-tipped cigarettes comprises twenty cigarettes, nineteen good cigarettes must be sacrificed to remove one flawed one).

On filter-tipped cigarette manufacturing systems, poorly filled tips are responsible for the rejection of large numbers of cigarettes, which means substantial economic losses for which a valid solution has not yet been devised.

Patent Application GB2284339 describes a filter-tipped cigarette in which the tobacco portion is divided into two axially separable parts, but in which the tip (where the tobacco is exposed) has no protection whatsoever.

Patent Application GB810759 describes a cigarette with no filter and comprising two paper hoods covering the two opposite ends of the tobacco portion, and both of which are removable axially to smoke the cigarette. Applying the paper hoods, however, involves a particularly complex folding operation, which cannot be performed correctly at high speed. In other words, on a modern cigarette manufacturing machine (capable of producing up to 20,000 cigarettes a minute), the folding operation would result in a reduction in speed that would be unacceptable.

DESCRIPTION OF THE INVENTION

It is an object of the present invention to provide a filter-tipped cigarette and relative manufacturing method and machine designed to eliminate the above drawbacks, and which at the same time are cheap and easy to implement.

According to the present invention, there are provided a filter-tipped cigarette and relative manufacturing method and machine, as claimed in the accompanying Claims.

BRIEF DESCRIPTION OF THE DRAWINGS

A number of non-limiting embodiments of the present invention will be described by way of example with reference to the attached drawings, in which.

PREFERRED EMBODIMENTS OF THE INVENTION

Figure 1:
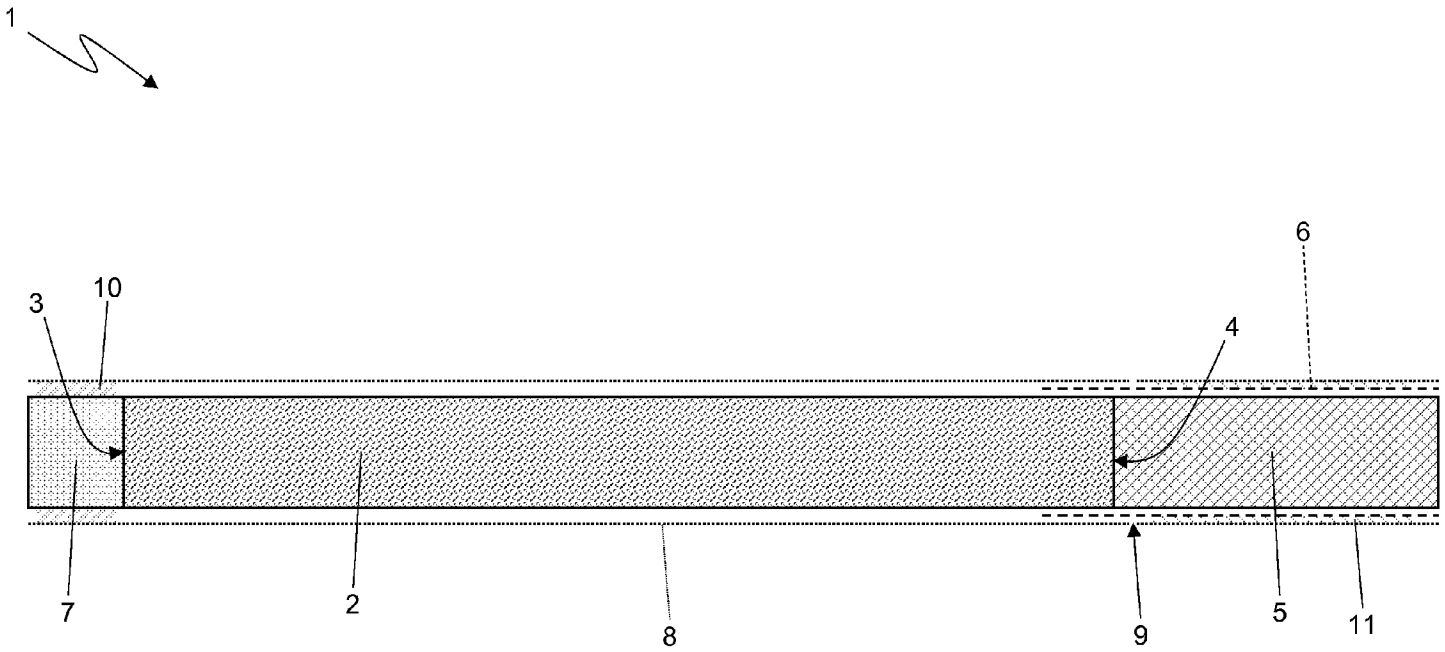
FIG. 1 shows a schematic longitudinal section of a filter-tipped cigarette in accordance with the present invention.

Number 1 in FIG. 1 indicates as a whole a filter-tipped cigarette.

Filter-tipped cigarette 1 comprises a cylindrical tobacco portion 2 having an outer end 3 and an opposite inner end 4; tobacco portion 2 is defined by a cylinder of tobacco wound in a sheet of paper, so that the tobacco is exposed at ends 3 and 4.

Filter-tipped cigarette 1 comprises a cylindrical filter 5 butt-connected to inner end 4 of tobacco portion 2. In the embodiments shown in the attached drawings, one end of filter 5 rests directly on inner end 4 of tobacco portion 2, but, in a different, perfectly equivalent embodiment not shown, at least one further element is interposed between the end of filter and inner end 4 of tobacco portion 2. Filter 5 is connected to tobacco portion 2 by a sleeve 6 wound about filter 5 and partly about tobacco portion 2. In actual use (i.e. when filter-tipped cigarette 1 is smoked by the user), outer end 3 of tobacco portion 2 is free (i.e. the tobacco is exposed); constitutes the tip of filter-tipped cigarette 1, and is used by the user to light filter-tipped cigarette 1.

Filter-tipped cigarette 1 also comprises a cap 7 butt-connected to outer end 3 of tobacco portion 2, at the opposite end from filter 5. In the embodiments shown in the attached drawings, one end of cap 7 rests directly on outer end 3 of tobacco portion 2, but, in a different, perfectly equivalent embodiment not shown, at least one further element is interposed between the end of cap 7 and outer end 3 of tobacco portion 2. Cap 7 is fixed to tobacco portion 2 by a sleeve 8, which is separate from and independent of sleeve 6, and is wound about cap 7 and tobacco portion 2. In the FIGS. 1 and 2 embodiments, sleeve 8 is also wound about filter 5 (and therefore over sleeve 6); whereas, in the FIGS.

3 and 4 embodiments, sleeve 8 is not wound about filter 5 (i.e. terminates short of, and is located alongside and a given distance from, sleeve 6).

It is important to note that sleeves 6 and 8 always have longitudinal adhesive strips (known and not shown in the drawings) to glue sleeves 6 and 8 firmly in the rolled position about tobacco portion 2 and/or filter 5. In addition, sleeve 6 always has adhesive strips (known and not shown in the drawings) to glue sleeve 6 to filter 5 and tobacco portion 2, so filter 5 is connected permanently and non-detachably to tobacco portion 2.

In the FIG. 1 embodiment, sleeve 8 has an annular tear line 9, which allows cap 7 to be pulled off tobacco portion 2. In other words, to smoke filter-tipped cigarette 1, the user pulls sleeve 8 axially off tobacco portion 2 together with, and to remove, cap 7. In actual use, the user grips filter 5 with one hand, and cap 7 with the other; pulls axially on cap 7 to tear sleeve 8 along tear line 9; and then removes cap 7 and the corresponding portion of sleeve 8 axially from the rest of filter-tipped cigarette 1. Once cap 7 is removed, filter-tipped cigarette 1 becomes an ordinary filter-tipped cigarette, which is smoked the usual way. In other words, tearing sleeve 8 along tear line 9 divides sleeve 8 into a movable portion integral with cap 7 and which is removed axially and disposed of; and into a fixed portion integral with and which remains fixed to filter 5.

Tear line 9 is normally defined by a weak line, which is torn by exerting axial pull on (and possibly also twisting) sleeve 8, and which comprises succession of cuts spaced apart in a circle around the whole of sleeve 8. The cuts composing the weak line may be straight and perfectly circumferential, may be straight and slope with respect to the circumference, or may be L-shaped with a circumferential portion and an axial portion. In an alternative embodiment not shown, tear line 9 is defined by two parallel weak lines defining a lateral tear-off strip, which is removed and disposed of.

In a different embodiment, tear line 9 is defined by a pull-off strip, which is much stronger mechanically than sleeve 8, is glued to sleeve 8, and has a free end which is gripped and pulled by the user. The pull-off strip may be used either together with one or more weak lines (over which the pull-off strip is glued) or on its own.

In the FIG. 1 embodiment, sleeve 8 (or rather the movable portion of sleeve 8) is glued to cap 7 using strong-stick glue 10 (i.e. permanent, drying glue with an adhesive force greater than the mechanical strength of sleeve 8), so the movable portion of sleeve 8 is non-detachable (unless it is torn) from cap 7. Similarly, sleeve 8 (or rather the fixed portion of sleeve 8) is glued to sleeve 6 using strong-stick glue 11 (i.e. permanent, drying glue with an adhesive force greater than the mechanical strength of sleeve 8), so the fixed portion of sleeve 8 is non-detachable (unless it is torn) from sleeve 6. In this embodiment, annular tear line 9 of sleeve 8 is located alongside glue 11, between cap 7 and glue 11 (typically close to the dividing line between filter 5 and tobacco portion 2, so that sleeve 8 is unaffected by combustion when smoking filter-tipped cigarette 1).

In the FIG. 2 embodiment, sleeve 8 is glued to sleeve 6 using weak-stick glue 11 (i.e. re-stick, non-dry glue or very weak permanent glue with an adhesive force well below the mechanical strength of sleeve 8). In this embodiment, sleeve 8 has no tear line 9, in that the whole of sleeve 8 is removed axially from tobacco portion 2 (and disposed of) by overcoming the force of glue 11.

An alternative embodiment has no glue 10 and/or no glue 11 (i.e. has neither glue 10 nor glue 11, or has glue 10 and no glue 11, or has glue 11 and no glue 10). In this connection, it is important to note that glues 10 and 11 are useful for improving the mechanical stability of sleeve 8 and cap 7, but are not strictly indispensable (especially glue 11), in that sleeve 8 enclosing cap 7 and tobacco portion 2 has a certain amount of mechanical stability even without glue 10 and/or glue 11.

Figure 2:
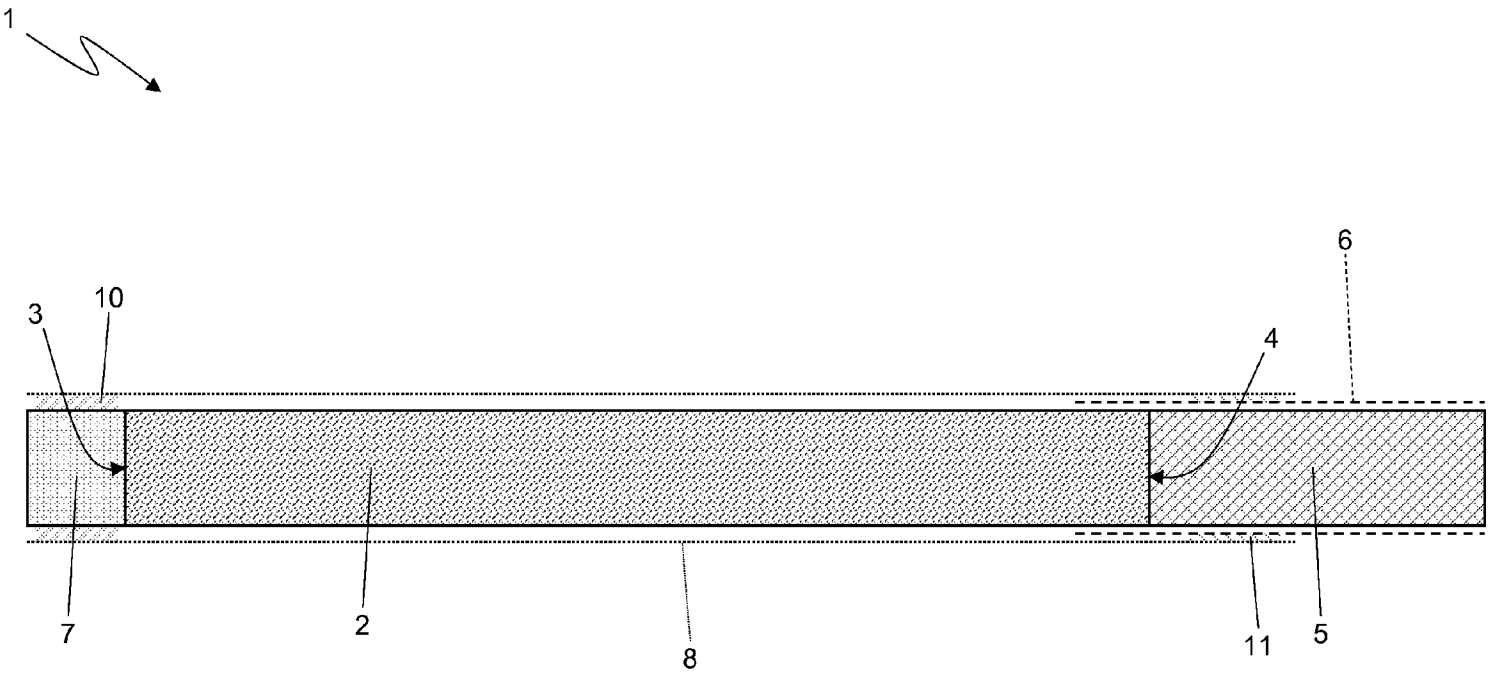
FIGS. 2-7 show schematic longitudinal sections of alternative embodiments of the FIG. 1 filter-tipped cigarette.
Figure 3:
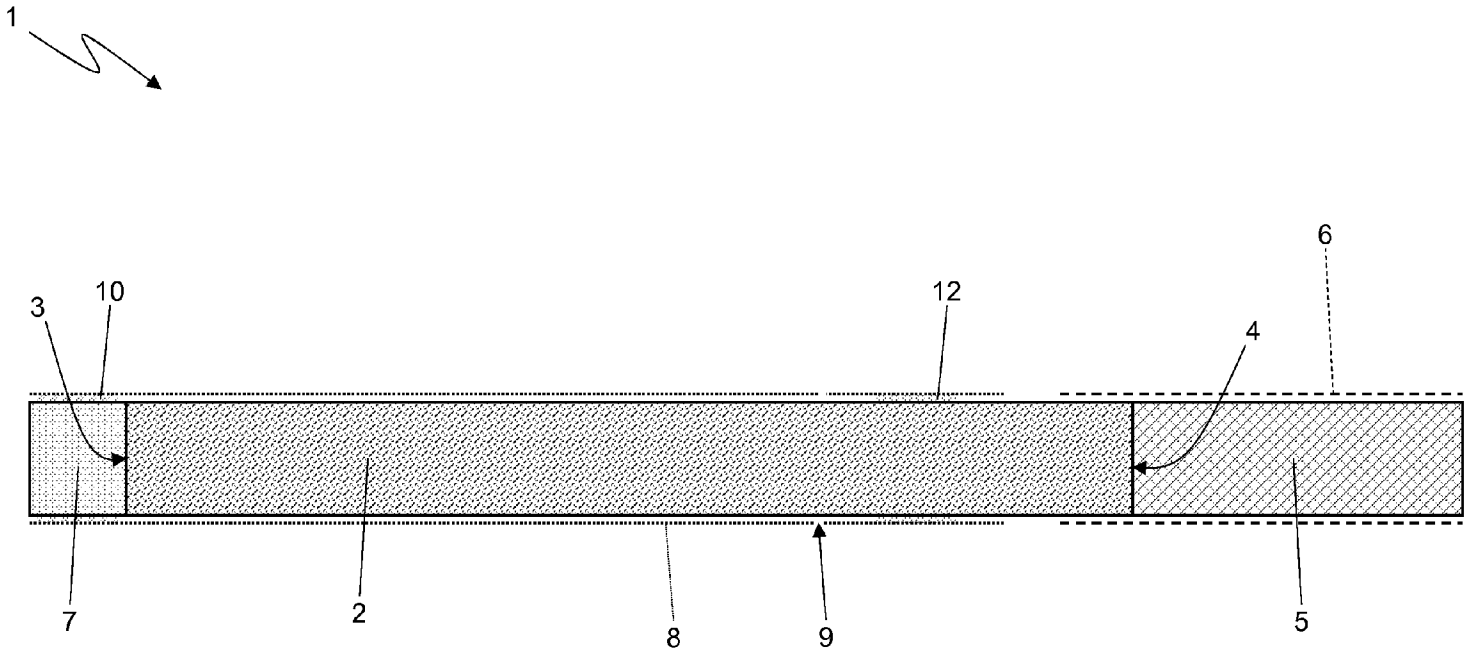
Figure 4:
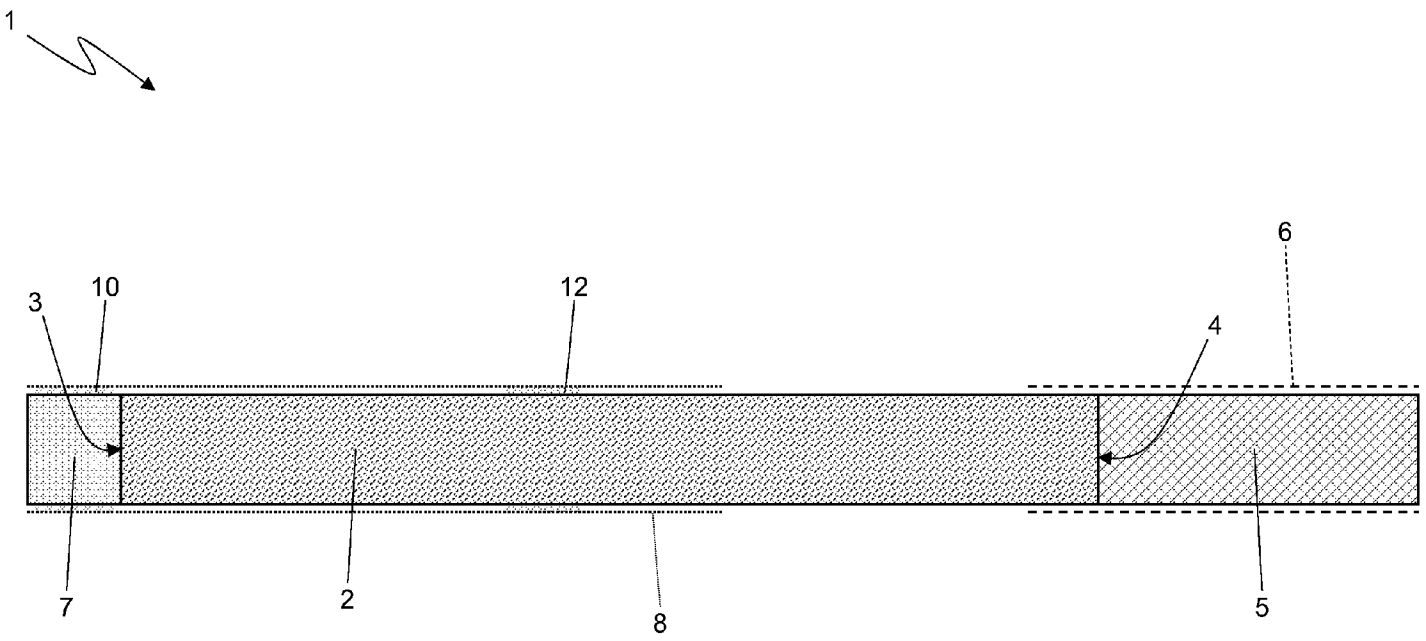

In the FIGS. 1 and 2 embodiments, sleeve 8 is also wound about filter 5 (and therefore over sleeve 6), whereas, in the FIGS. 3 and 4 embodiments, sleeve 8 is not wound about filter 5 (i.e. terminates short of, and is located alongside and a given distance from, sleeve 6).

In the FIG. 3 embodiment, sleeve 8 is glued to tobacco portion 2 using strong-stick glue 12 (i.e. permanent, drying glue with an adhesive force greater than the mechanical strength of sleeve 8); and annular tear line 9 of sleeve 8 is located alongside glue 12, between cap 7 and glue 12. Tearing sleeve 8 along tear line 9 divides sleeve 8 into the movable portion integral with cap 7 and which is removed axially and disposed of; and into the fixed portion integral with and which remains fixed to tobacco portion 2.

In the FIG. 4 embodiment, sleeve 8 is glued to tobacco portion 2 using weak-stick glue 12 (i.e. re-stick, non-dry glue or very weak permanent glue with an adhesive force well below the mechanical strength of sleeve 8). In this embodiment, sleeve 8 has no tear line 9, in that the whole of sleeve 8 is removed axially from tobacco portion 2 (and disposed of) by overcoming the force of glue 12.

Figure 5:
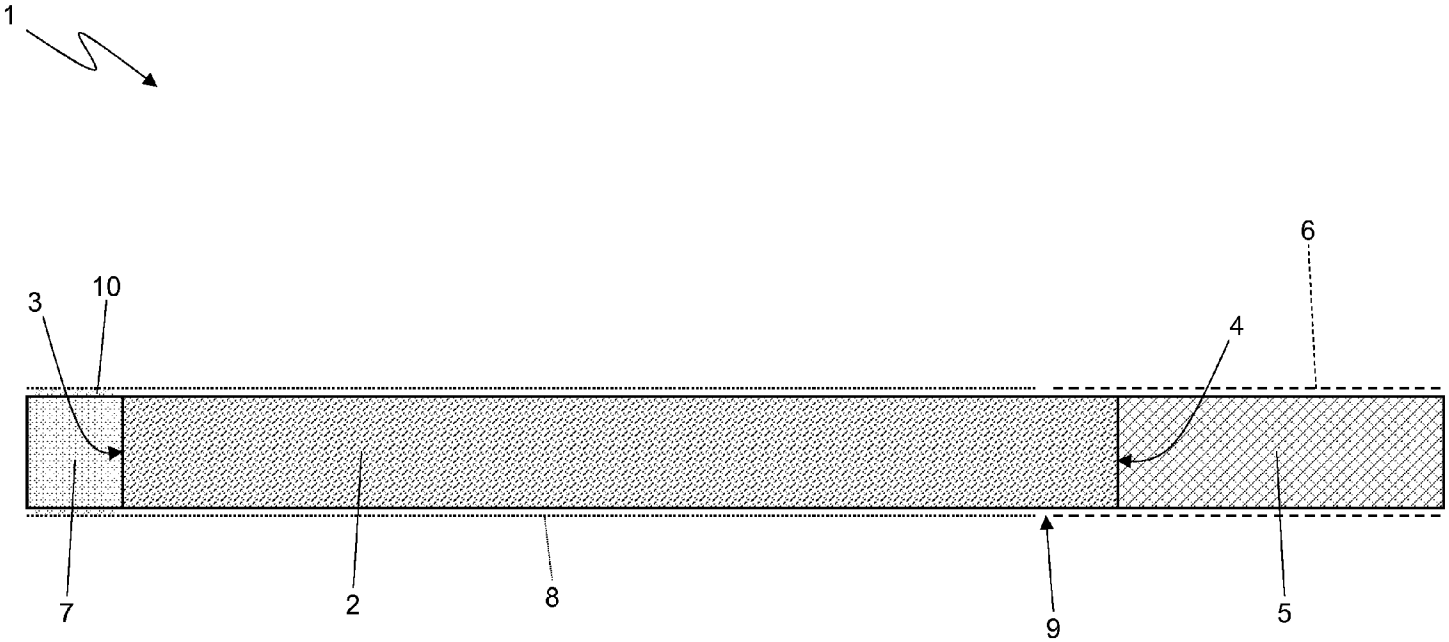

In the FIG. 5 embodiment, sleeve 6 and sleeve 8 are initially joined at annular tear line 9, which allows sleeve 8 to be torn off sleeve 6 when sleeve 8 is removed axially from tobacco portion 2 together with, and to remove, cap 7. In this embodiment, sleeve 8 is preferably (but not necessarily) glued to cap 7 using strong-stick glue 10 (i.e. permanent, drying glue with an adhesive force greater than the mechanical strength of sleeve 8).

Figure 6:
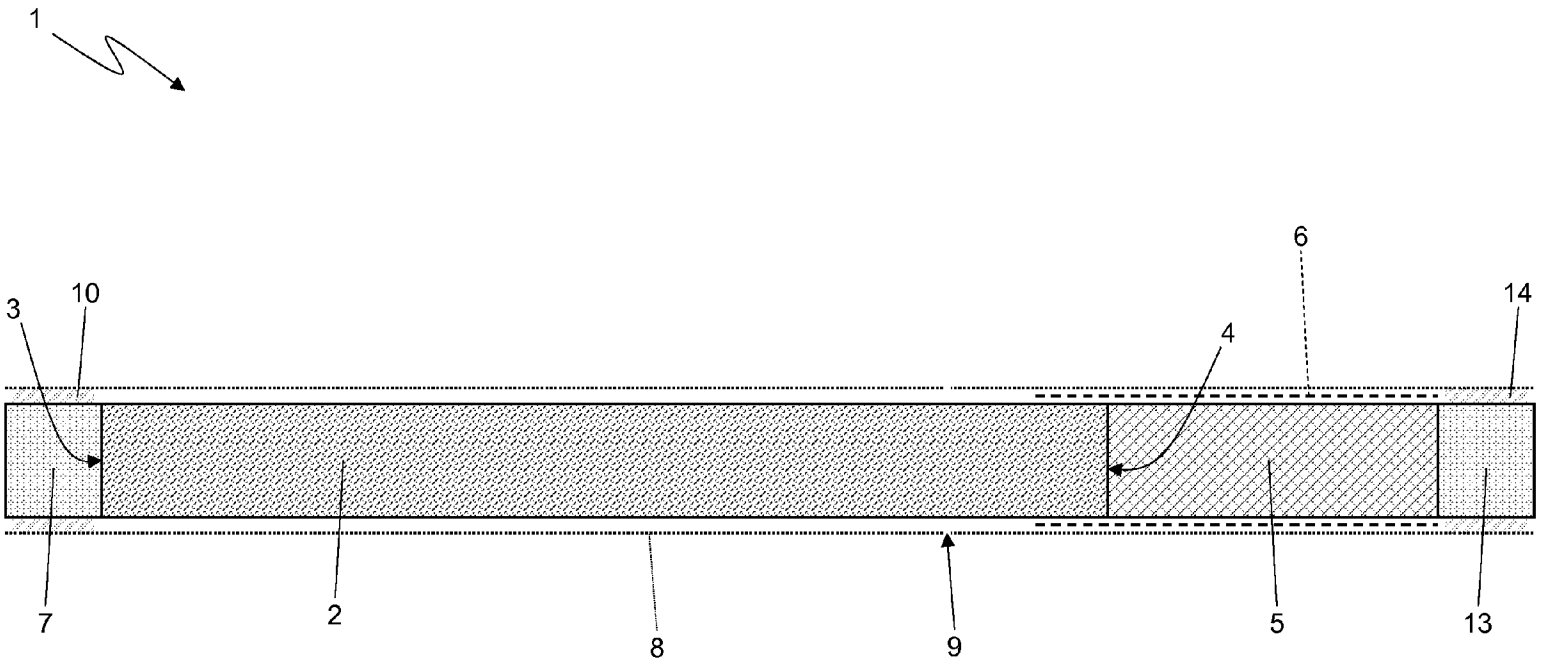

In the FIG. 6 embodiment, filter-tipped cigarette 1 comprises a further cap 13, which is located at the opposite end from cap 7, rests against the outer end of filter 5, and is removable (at the same time as cap 7) to smoke filter-tipped cigarette 1. Like cap 7, cap 13 is preferably glued to sleeve 8 using strong-stick glue (i.e. permanent, drying glue with an adhesive force greater than the mechanical strength of sleeve 8). In the FIG. 6 embodiment, sleeve 8 is wound about cap 7 and cap 13, and so has annular tear line 9. In the FIG. 6 embodiment, sleeve 8 is preferably not glued to either tobacco portion 2 or sleeve 6, in that, even without glue 11 or 12, sleeve 8 cannot be removed axially from tobacco portion 2 or filter 5 without tearing sleeve 8 along tear line 9.

Figure 7:
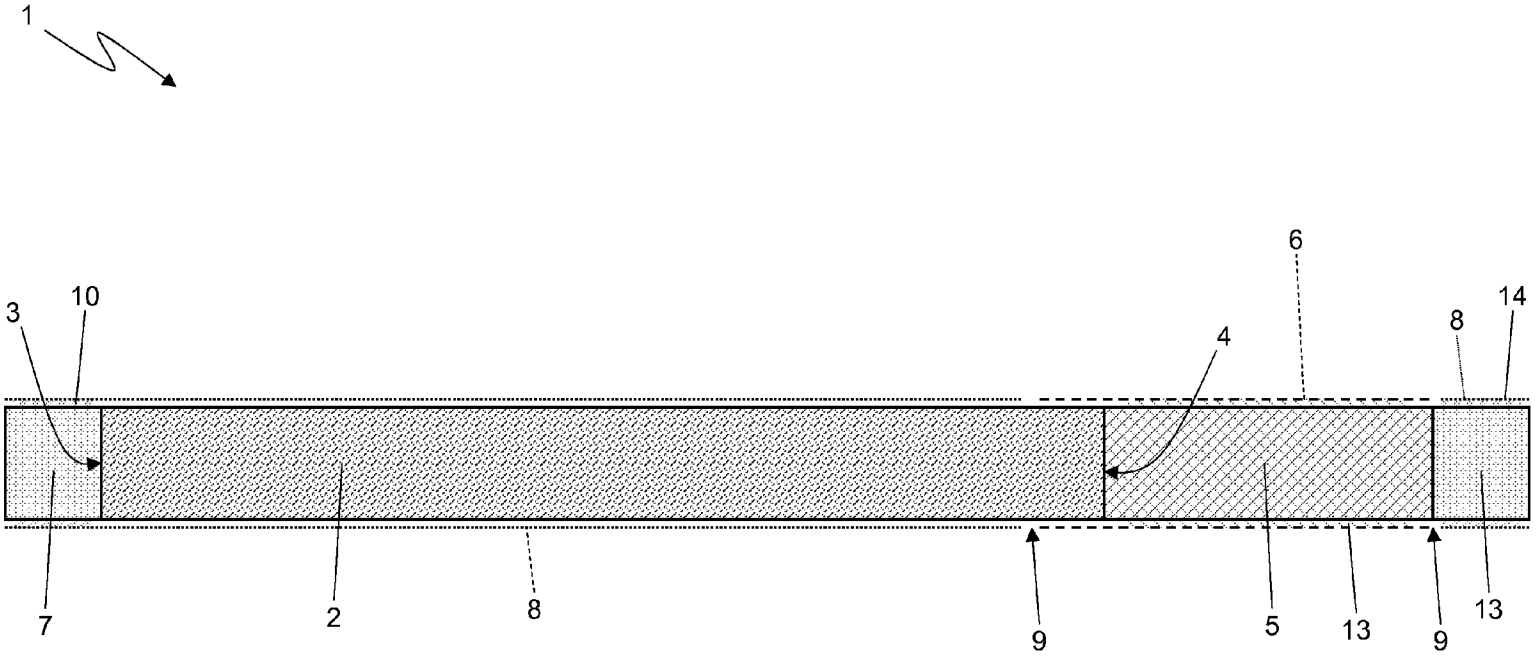

In the FIG. 7 embodiment, filter-tipped cigarette comprises both caps 7 and 13; and two sleeves 8 located at opposite ends of sleeve 6 and initially joined to sleeve 6 at respective annular tear lines 9. In actual use, the user tears off the two sleeves 8 (integral with respective caps 7 and 13) along the two annular tear lines 9, to remove sleeves 8 together with respective caps 7 and 13 from filter-tipped cigarette 1. In this embodiment, sleeves 8 are preferably (but not necessarily) glued to respective caps 7 and 13 using strong-stick glues 10 and 14 (i.e. permanent, drying glues with an adhesive force greater than the mechanical strength of sleeves 8).

In a preferred, but not compulsory, embodiment, caps 7 and 13 are made of filter manufacturing material (e.g. acetate), i.e. caps 7 and 13 may be made from the same material as filter 5. Making caps 7 and 13 from normally used filter manufacturing material has the advantage that this material is in itself cheap and, above all, is available in large quantities at cigarette factories, thus eliminating the economic and logistic drawbacks involved in procuring additional material. In an alternative embodiment, caps 7 and 13 are made from any type of low-density plastic material (e.g. polystyrene foam) or rolled paper/cardboard. It is important to note that, whichever the case, caps 7 and 13 do not have the necessary filtering properties or size to act as filters, even when made from filter manufacturing material (and even more so when made from plastic or paper). Cap 7 serves solely to mechanically protect the tip (i.e. outer end 3 of tobacco portion 2) of filter-tipped cigarette 1, and must be removed prior to smoking the cigarette (i.e. cap 7 can never be used instead of filter 5, which is the only part of filter-tipped cigarette 1 with suitable filtering properties). Similarly, cap 13 serves solely to protect the free end of filter 5 from contamination, and must be removed prior to smoking filter-tipped cigarette 1 (i.e. cap 13 can never be used together with filter 5, which is the only part of filter-tipped cigarette 1 with suitable filtering properties).

Cap 7 of filter-tipped cigarette 1 described may have graphic marks and/or patterns. Preferably, the graphic marks and/or patterns on cap 7 are printed. In one embodiment, cap 7 has fluorescent graphic marks and/or patterns.

Cap 13 of filter-tipped cigarette 1 described may have graphic marks and/or patterns. Preferably, the graphic marks and/or patterns on cap 13 are printed. In one embodiment, cap 13 has fluorescent graphic marks and/or patterns.

Sleeve 8 of filter-tipped cigarette 1 described may have graphic marks and/or patterns. Preferably, the graphic marks and/or patterns on sleeve 8 are printed. In one embodiment, sleeve 8 has fluorescent graphic marks and/or patterns.

Inside the packet of cigarettes, filter-tipped cigarettes 1 may be inserted with caps 7 or 13 visible (i.e. at the top extraction opening of the packet). In which case, at least some of caps 7 or 13 may be printed with patterns or wording visible when the packet is opened, and/or at least some of caps 7 or 13 may have gripping means to facilitate grip (and therefore axial withdrawal) of the corresponding filter-tipped cigarettes 1. For example, one cap 7 or 13 may have gripping means defined by an outer insert (thread or tape) fixed to cap 7 or 13, or defined by appropriately shaping cap 7 or 13 (for example, cap 7 or 13 may be laser sculpted, or may be pressed or cut mechanically). It is important to note that each packet of cigarettes need only contain one filter-tipped cigarette 1 with a cap 7 or 13 with gripping means, in that only the first filter-tipped cigarette 1 is difficult to withdraw and, once this is removed, the rest can be withdrawn fairly easily.

In one embodiment, cap 7 and/or cap 13 may be impregnated with aromatic substances to impart a given aroma to the tobacco in tobacco portion 2 (the aroma seeps slowly by proximity from cap 7 or 13 to the tobacco in tobacco portion 2 or to filter 5).

In another embodiment, sleeve 8 may be impregnated with aromatic substances.

Menthol is the preferred aromatic substance used to aromatize cap 7 and/or cap 13 and/or sleeve 8.

Cigarette 1 described has numerous advantages.

Firstly, cap 7 of filter-tipped cigarette 1 described prevents tobacco fallout from the tip (i.e. from outer end 3 of tobacco portion 2) during the packing process to form the packet of cigarettes, as well as during subsequent transport and handling of the packet.

Secondly, sleeve 8 covering at least part of filter-tipped cigarette 1 provides a large area for printed advertising or embellishments, and, being 'disposable' material which is eliminated prior to smoking the cigarette, poses no restrictions as to the choice of ink (e.g. fluorescent paints may safely be used). Likewise, the exposed face of cap 7 or 13 also provides an area for printed advertising or embellishments, and, being 'disposable' material which is eliminated prior to smoking the cigarette, poses no restrictions as to the choice of ink.

Finally, filter-tipped cigarette 1 described is also better suited for single (i.e. loose) retail, by being mechanically stronger and better sealed than conventional filter-tipped cigarettes. Filter-tipped cigarette 1 in FIGS. 6 and 7 is particularly suitable for loose retail, by tobacco portion 2 and filter 5 being sealed completely by caps 7 and 13 and sleeve 8, which are all fully removed and disposed of prior to smoking filter-tipped cigarette 1.

FIG. 8 show a manufacturing sequence by which to produce the filter-tipped cigarette in FIG. 1. Because this sequence involves connecting cap 7 and filter 5 at the same time to tobacco portion 2, a conventional filter assembly machine must be modified accordingly.

Figures 8A, 8B, 8C, 8D, 8E, 8F, 8G, 8H:
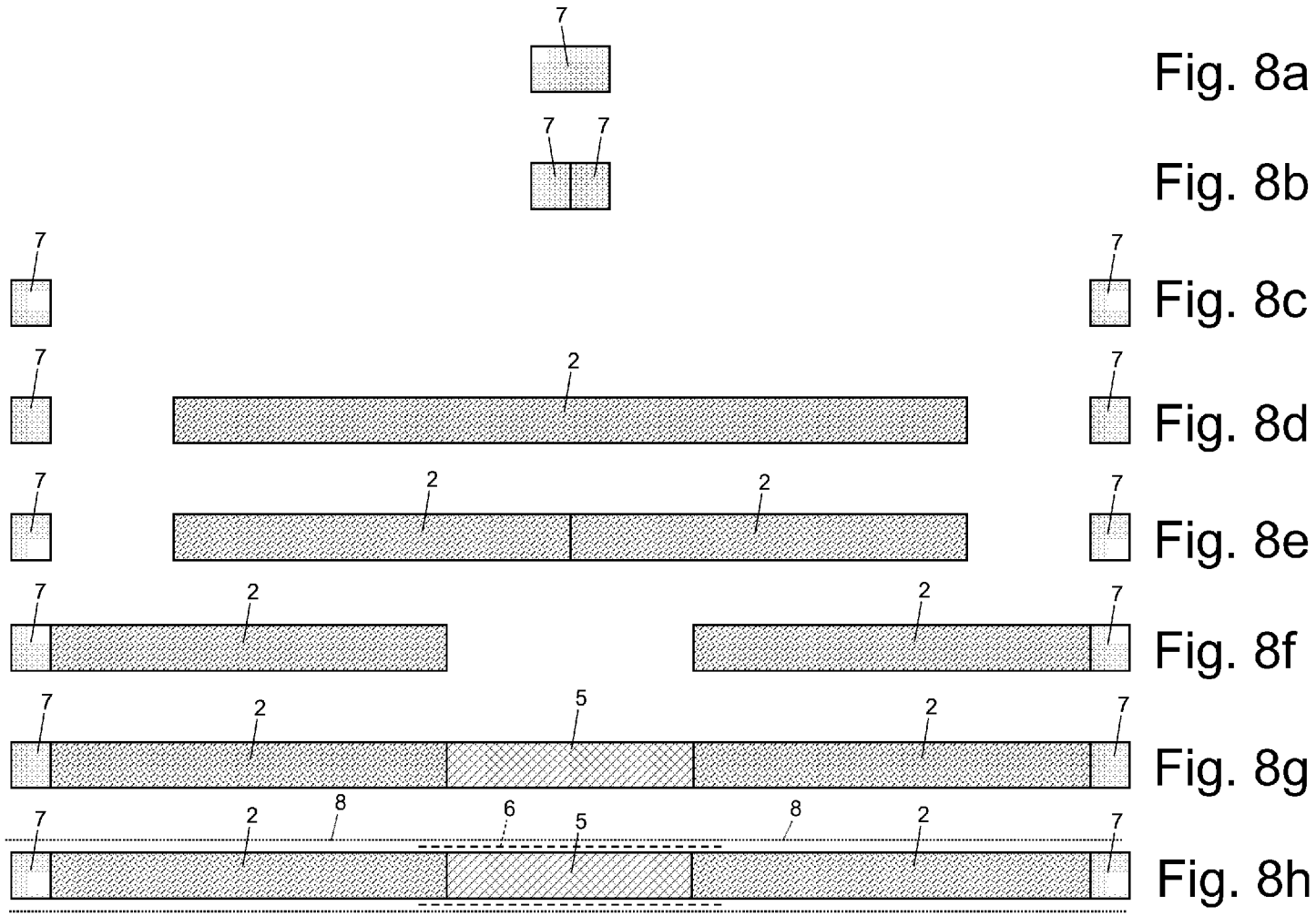
FIG. 8 show schematics of a manufacturing sequence by which to produce the FIG. 1 filter-tipped cigarette.

As shown in FIG. 8*a*, to begin with, a double cap (i.e. twice as long as cap 7 of each filter-tipped cigarette 1) is cut in half by a blade into two side by side caps 7 (FIG. 8*b*). As shown in FIG. 8*c*, the two side by side caps 7 are parted axially to form a gap, into which a double tobacco portion 2 (i.e. twice as long as tobacco portion 2 of each filter-tipped cigarette 1) is fed, as shown in FIG. 8*d*. As shown in FIG. 8*e*, the double tobacco portion 2 is cut in half by a blade into two tobacco portions 2. As shown in FIG. 8*f*, the two side by side tobacco portions 2 are parted axially to contact respective caps 7 and at the same time form a gap, into which a double filter 5 (i.e. twice as long as filter 5 of each filter-tipped cigarette 1) is fed, as shown in FIG. 8*g*.

As shown in FIG. 8*h*, a double sleeve 6 (i.e. twice as long as sleeve 6 of each filter-tipped cigarette 1) is wound about double filter 5 and partly about tobacco portions 2; and a double sleeve 8 (i.e. twice as long as sleeve 8 of each filter-tipped cigarette 1) is wound about double filter 5, tobacco portions 2 and caps 7, and over double sleeve 6. In one embodiment, double sleeve 6 is wound on first, and double sleeve 8 is wound on afterwards, completely independently of double sleeve 6. Alternatively, double sleeve 6 is first superimposed on double sleeve 8, and both double sleeves 6 and 8 (formed into one) are wound on together simultaneously. Once both double sleeves 6 and 8 are wound on, double filter 5 and double sleeves 6 and 8 are cut centrally by a blade to divide the two filter-tipped cigarettes 1 joined at filters 5.

The FIG. 8 manufacturing sequence produces two parallel filter-tipped cigarettes 1 at a time. Alternatively, one filter-tipped cigarette 1 may be produced at a time.

FIG. 9 show a manufacturing sequence by which to produce the filter-tipped cigarette in FIG. 1. Because this sequence involves connecting cap 7 after filter 5 to tobacco portion 2, no substantial changes are needed to a conventional filter assembly machine. That is, the conventional filter assembly machine connects filter 5 to tobacco portion 2; and, downstream from the conventional filter assembly machine, tobacco portion 2, already fitted with filter 5 (and therefore with sleeve 6 connecting filter 5 integrally to tobacco portion 2), is processed on a cap assembly machine (in series with the conventional filter assembly machine) to connect cap 7 to tobacco portion 2.

Figures 9A, 9B, 9C, 9D, 9E, 9F:
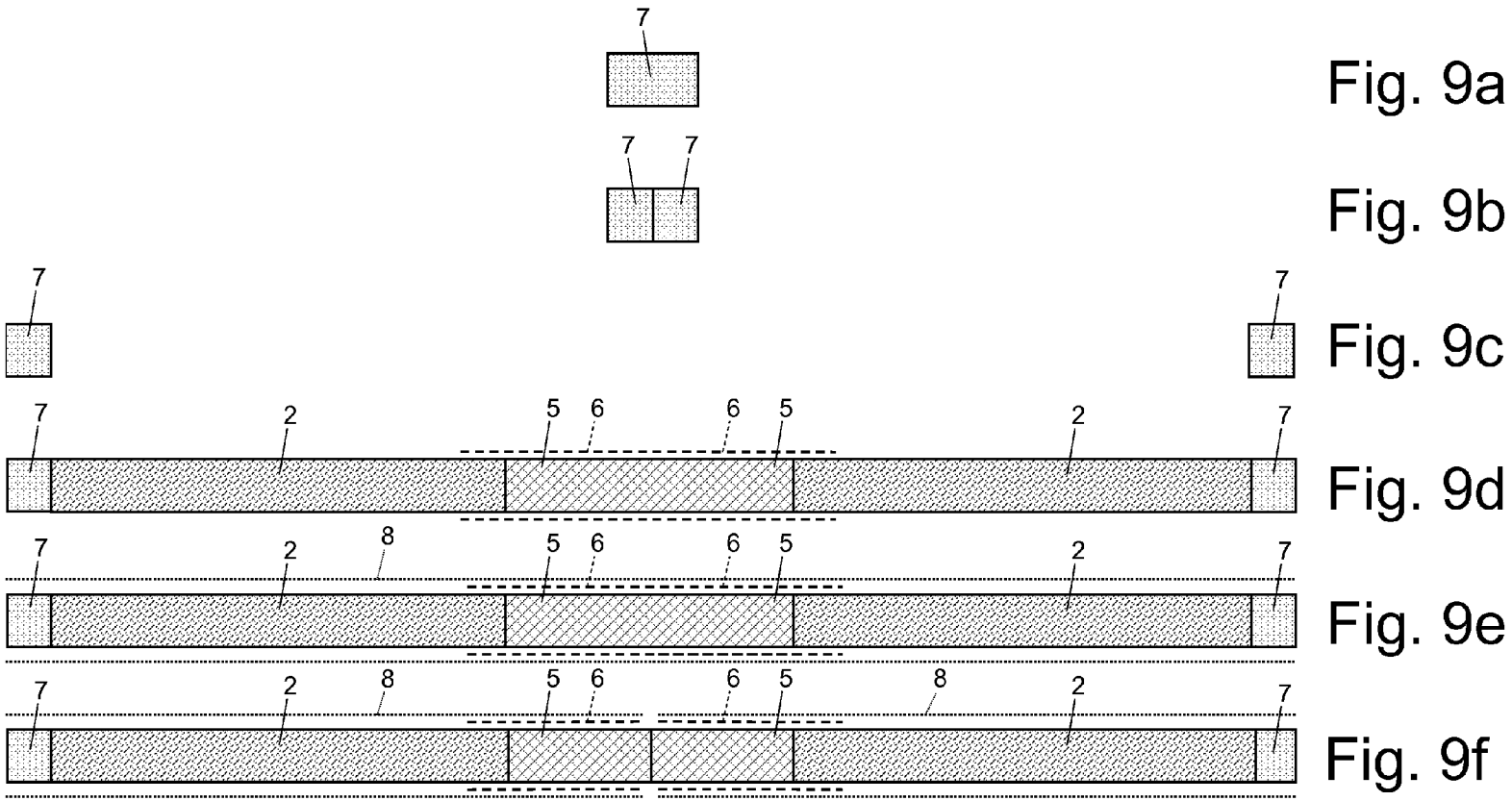
FIGS. 9 and 10 show schematics of two alternative manufacturing sequences by which to produce the FIG. 1 filter-tipped cigarette.

As shown in FIG. 9*a*, to begin with, a double cap (i.e. twice as long as cap 7 of each filter-tipped cigarette 1) is cut in half by a blade into two side by side caps 7 (FIG. 9*b*). As shown in FIG. 9*c*, the two side by side caps 7 are parted axially to form a gap, into which two tobacco portions 2, already fitted with a double filter 5 (i.e. twice as long as filter 5 of each filter-tipped cigarette 1) and with a corresponding double sleeve 6 (i.e. twice as long as sleeve 6 of each filter-tipped cigarette 1), are fed as shown in FIG. 9*d*. The two tobacco portions 2 are joined axially by double filter 5 and double sleeve 6 (alternatively, the two tobacco portions 2 may be fed, already divided axially, i.e. at filters 5, into the gap between the two caps 7). As shown in FIG. 9*e*, a double sleeve 8 (i.e. twice as long as sleeve 8 of each filter-tipped cigarette 1) is wound about double filter 5, tobacco portions 2 and caps 7, and over double sleeve 6. As shown in FIG. 9*f*, once double sleeve 8 is wound on, double filter 5 and double sleeves 6 and 8 are cut centrally by a blade to divide the two filter-tipped cigarettes 1 joined at filters 5.

The only alteration needed to the conventional filter assembly machine is therefore eliminating the central cut of double filter 5 (and of corresponding double sleeve 6), which is carried out later on the cap assembly machine after winding on double sleeve 8.

Figures 10A, 10B, 10C:
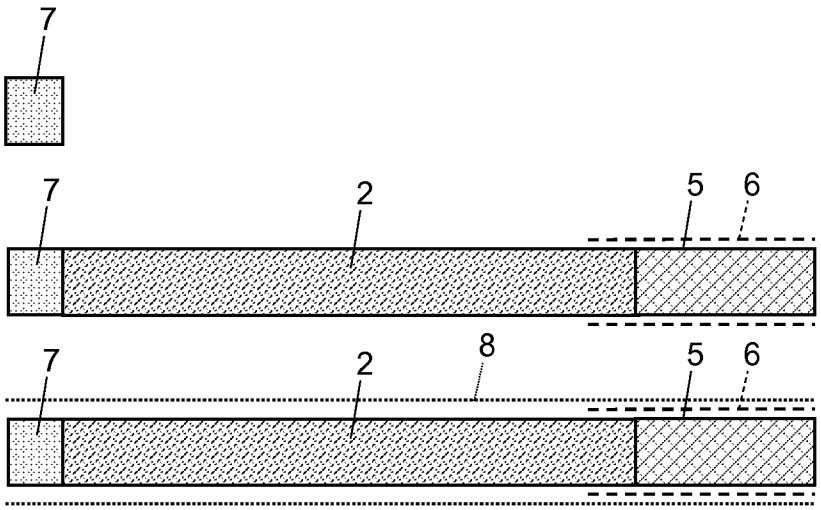

FIG. 10 show a variation of the FIG. 9 manufacturing sequencer the FIG. 9 manufacturing sequence produces two parallel filter-tipped cigarettes at a time, whereas the FIG. 10 manufacturing sequence produces only one filter-tipped cigarette 1 at a time.

Figures 11A, 11B, 11C, 11D, 11E, 11F, 11G, 11H:
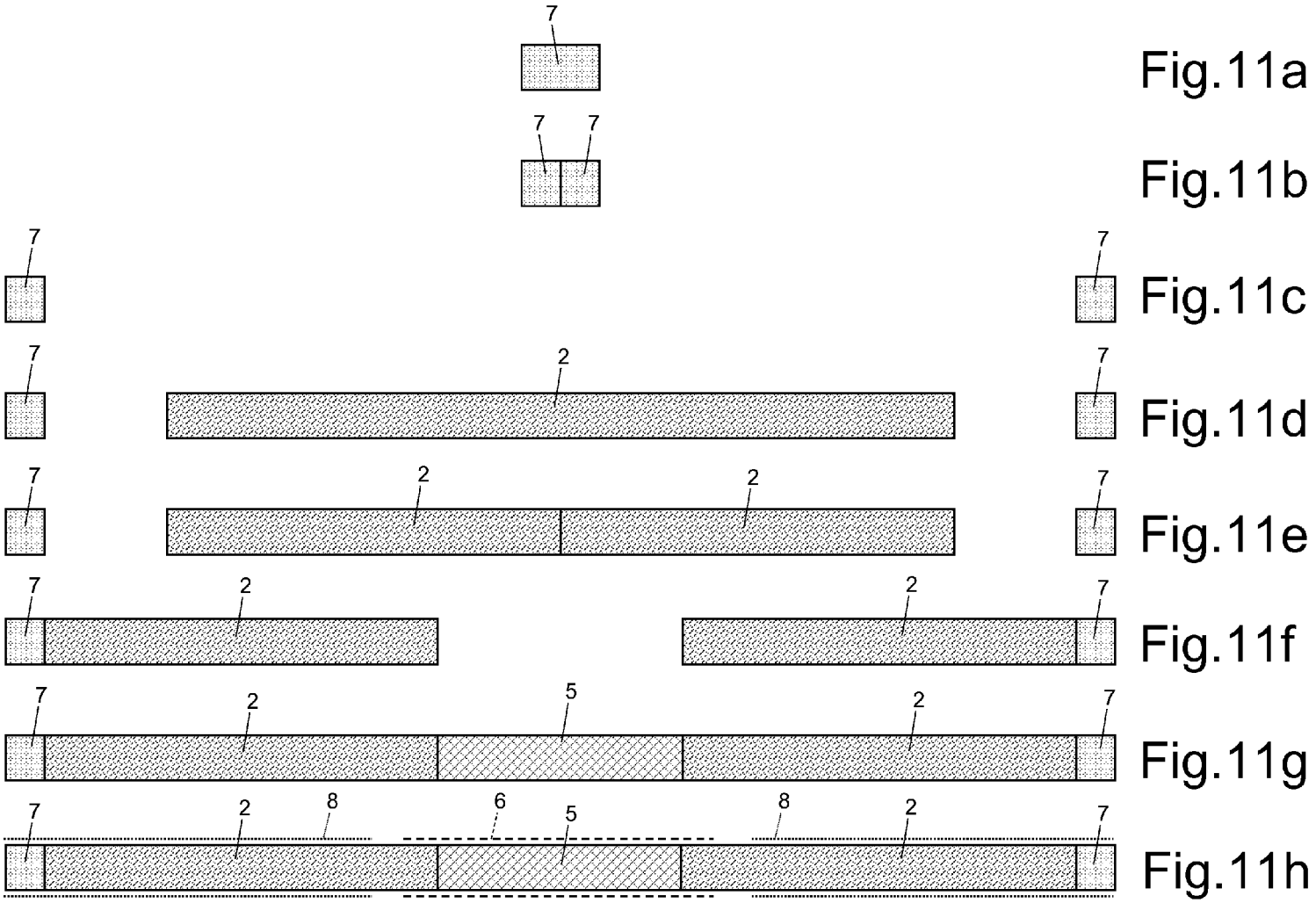
FIG. 11 show schematics of a manufacturing sequence by which to produce the FIG. 3 filter-tipped cigarette.

The FIG. 8-10 manufacturing sequences for producing filter-tipped cigarette 1 and described in detail above may also be applied to produce the FIGS. 3 and 4 filter-tipped cigarettes 1. The only difference is that, sleeve 8 not being superimposed on sleeve 6 in the FIGS. 3 and 4 filter-tipped cigarettes 1, sleeves 6 and 8 are always wound on physically separately (even when wound on simultaneously). Moreover, using the FIG. 9 manufacturing sequence, the double filter 5 and corresponding double sleeve 6 may already be cut into half (i.e. into two filters 5 and two corresponding sleeves 6) when the two tobacco portions 2 are fed into the gap between the two caps 7 as shown in FIG. 9*d*. By way of a further example, FIG. 11 show the manufacturing sequence for producing the FIGS. 3 and 4 filter-tipped cigarettes 1 in exactly the same way as in FIG. 8.

Figures 12A, 12B, 12C, 12D, 12E, 12F, 12G, 12H:
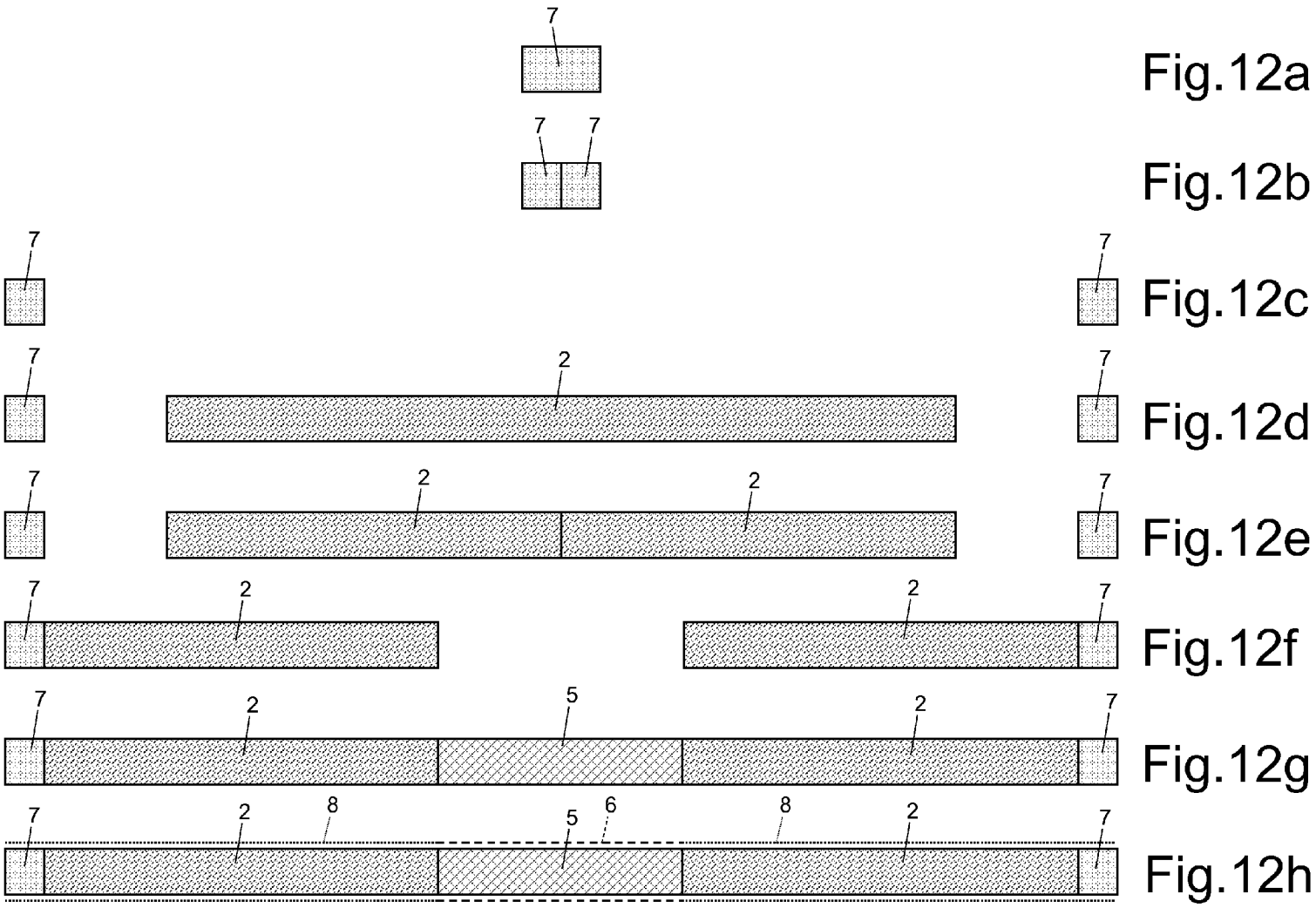
FIG. 12 show schematics of a manufacturing sequence by which to produce the FIG. 5 filter-tipped cigarette.

The FIG. 8 manufacturing sequence for producing filter-tipped cigarette 1 and described in detail above may also be applied to produce the FIG. 5 filter-tipped cigarette 1. The only difference is that, sleeve 8 being initially joined to sleeve 6 in the FIG. 5 filter-tipped cigarette 1, sleeves 6 and 8 are always wound on together and simultaneously. By way of a further example, FIG. 12 show the manufacturing sequence for producing the FIG. 5 filter-tipped cigarette 1 in exactly the same way as in FIG. 8.

FIG. 13 show a manufacturing sequence by which to produce the FIG. 6 filter-tipped cigarette. Because this sequence involves connecting caps 7 and 13 and filter 5 at the same time to tobacco portion 2, a conventional filter assembly machine must be modified accordingly.

Figures 13A, 13B, 13C, 13D, 13E, 13F, 13G, 13H:
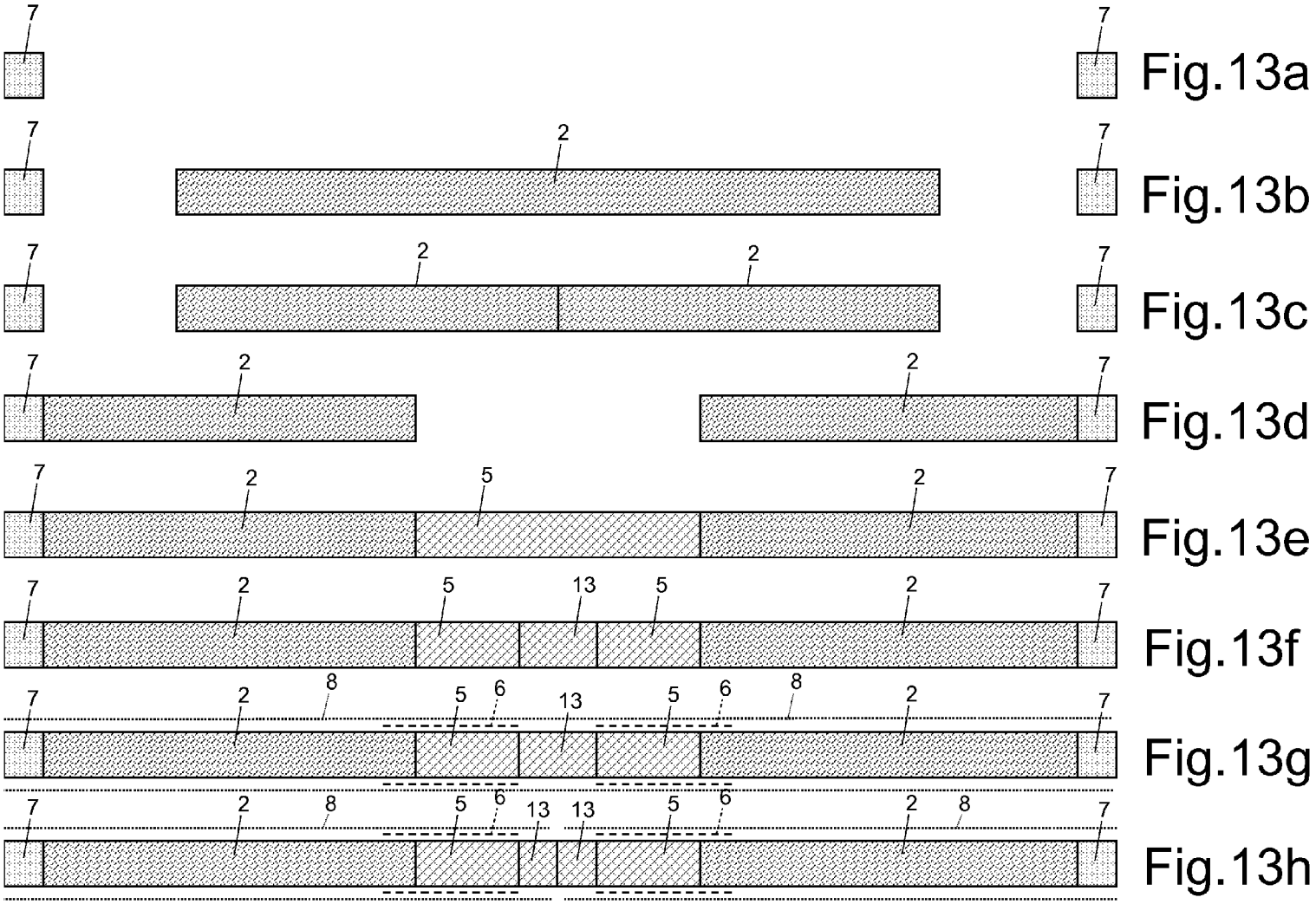
FIG. 13 show schematics of a manufacturing sequence by which to produce the FIG. 6 filter-tipped cigarette.

To begin with, a double cap 7 (i.e. twice as long as cap 7 of each filter-tipped cigarette 1) is cut in half by a blade into two side by side caps 7. As shown in FIG. 13*a*, the two side by side caps 7 are parted axially to form a gap, into which a double tobacco portion 2 (i.e. twice as long as tobacco portion 2 of each filter-tipped cigarette 1) is fed, as shown in FIG. 13*b*. As shown in FIG. 13*c*, the double tobacco portion 2 is cut in half by a blade into two tobacco portions 2. As shown in FIG. 13*d*, the two side by side tobacco portions 2 are parted axially to contact respective caps 7 and at the same time form a gap, into which a more than double filter 5 (i.e. more than twice as long as filter 5 of each filter-tipped cigarette 1) is fed, as shown in FIG. 13*e*.

As shown in FIG. 13*f*, the more than double filter 5 is cut at two points by two side by side blades to form two filters 5 on either side (and butt-connected to the two tobacco portions 2) and a double cap 13 (i.e. twice as long as cap 13 of each filter-tipped cigarette 1) in the middle. In this embodiment, cap 13 is obviously made of the same material as filter 5. As shown in FIG. 13*g*, a sleeve 6 is wound about each filter 5 and partly about the corresponding tobacco portion 2; and a double sleeve 8 (i.e. twice as long as sleeve 8 of each filter-tipped cigarette 1) is wound about filters 5, tobacco portions 2 and caps 7 and 13, and over sleeves 6. In one embodiment, sleeves 6 are wound on first, and double sleeve 8 is wound on afterwards, completely independently of sleeves 6. Alternatively, sleeves 6 are first superimposed on double sleeve 8, and sleeves 6 and double sleeve 8 (formed into one) are wound on together simultaneously. Once sleeves 6 and double sleeve 8 are wound on, double cap 13 and double sleeve 8 are cut centrally by a blade, as shown in FIG. 13*h*, to form two separate caps 13 and so divide the two filter-tipped cigarettes 1 joined at caps 13.

FIG. 14 show a manufacturing sequence by which to produce the FIG. 6 filter-tipped cigarette. Because this sequence involves connecting caps 7 and 13 after filter 5 to tobacco portion 2, no substantial changes are needed to a conventional filter assembly machine. That is, the conventional filter assembly machine connects filter 5 to tobacco portion 2; and, downstream from the conventional filter assembly machine, tobacco portion 2, already fitted with filter 5 (and therefore with sleeve 6 connecting filter 5 integrally to tobacco portion 2), is processed on a cap assembly machine (in series with the conventional filter assembly machine) to connect caps 7 and 13 to tobacco portion 2.

Figures 14A, 14B, 14C, 14D, 14E, 14F, 14G:
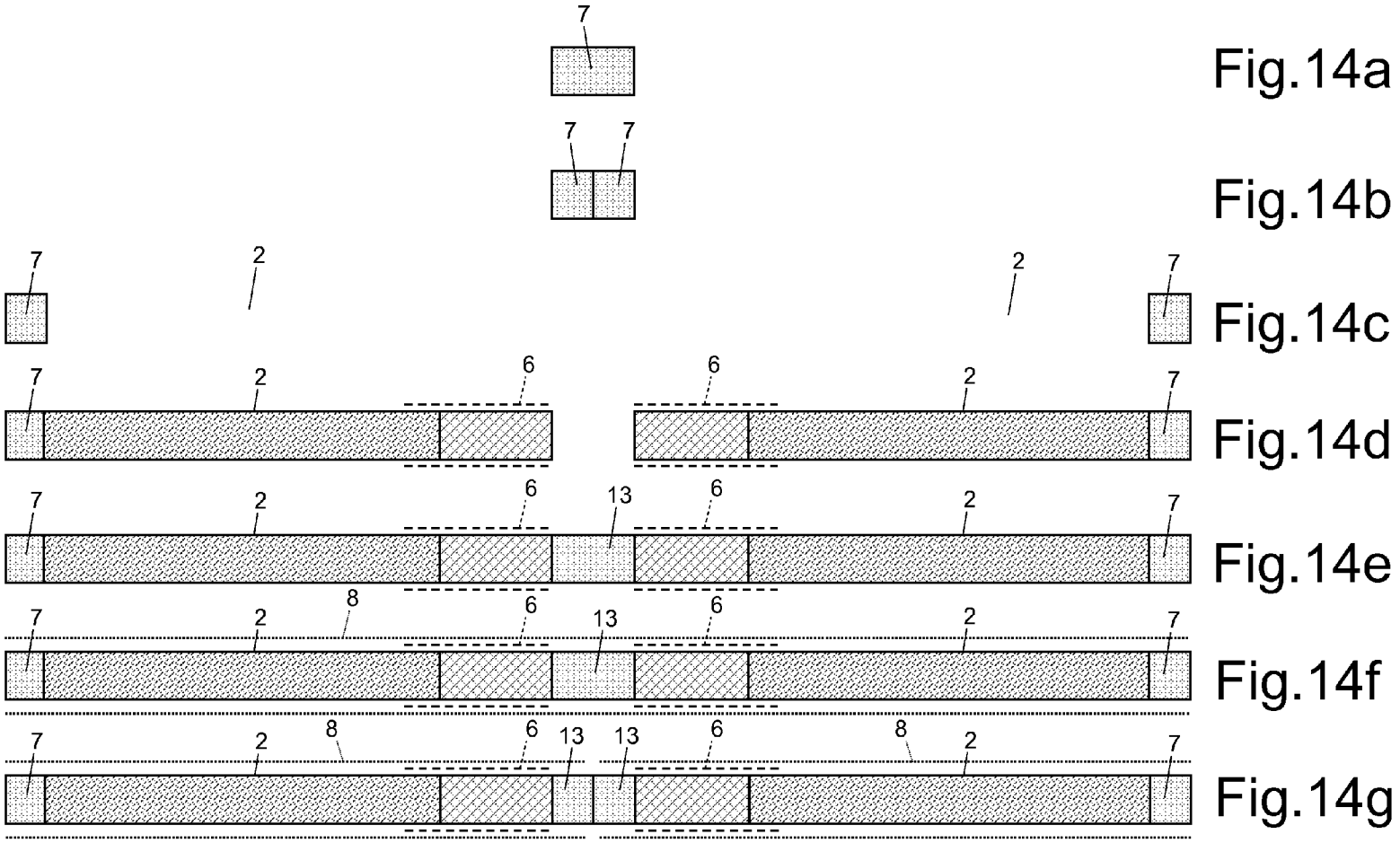
FIGS. 14 and 15 show schematics of two alternative manufacturing sequences by which to produce the FIG. 6 filter-tipped cigarette.

As shown in FIG. 14*a*, to begin with, a double cap (i.e. twice as long as cap 7 of each filter-tipped cigarette 1) is cut in half by a blade into two side by side caps 7 (FIG. 14*b*). As shown in FIG. 14*c*, the two side by side caps 7 are parted axially to form a gap, into which two tobacco portions 2, each already fitted with filter 5 and sleeve 6, are fed as shown in FIG. 14*d*. The two filters 5 are positioned a given axial distance apart, so as to form a gap, into which a double cap 13 (i.e. twice as long as cap 13 of each filter-tipped cigarette 1) is fed as shown in FIG. 14*e*. As shown in FIG. 14*f*, a double sleeve 8 (i.e. twice as long as sleeve 8 of each filter-tipped cigarette 1) is wound about filters 5, tobacco portions 2 and caps 7 and 13, and over sleeves 6. As shown in FIG. 14*g*, once double sleeve 8 is wound on, double cap 13 and double sleeve 8 are cut centrally by a blade to form two separate caps 13 and so divide the two filter-tipped cigarettes 1 joined at caps 13.

As regards the FIG. 14*d* step, the two tobacco portions 2 fitted with filters 5 and with sleeves 6 may be supplied already separated, or may be supplied joined at filters 5, and be cut centrally later on.

Figures 15A, 15B, 15C:
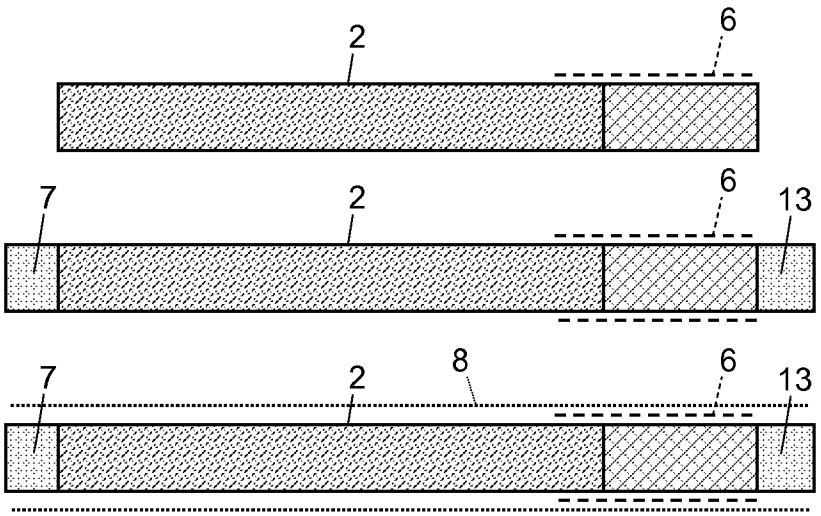

The FIG. 14 manufacturing sequence produces two parallel filter-tipped cigarettes 1 at a time. Alternatively, one filter-tipped cigarette 1 may be produced at a time, as shown in FIG. 15.

The above sequences for producing filter-tipped cigarettes 1 are performed on a manufacturing machine for producing filter-tipped cigarette 1. The manufacturing machine comprises: a rolling unit for producing a tobacco portion 2 having an outer end 3 and an inner end 4; a first connecting station for butt-connecting a filter 5 to inner end 4 of tobacco portion 2; a first winding station for winding a sleeve 6 about tobacco portion 2 and filter 5, to connect filter 5 second connecting station for butt-connecting a cap 7 to outer end 3 of tobacco portion 2, so the cap is located at the opposite end from filter 5 and is removable to permanently and non-detachably to tobacco portion 2; a smoke filter-tipped cigarette 1; and a second winding station for winding a sleeve 8 about cap 7 and tobacco portion 2, so sleeve 8 is integral with cap 7 and at least partly removable axially from tobacco portion 2 together with, and to remove, cap 7.

The above sequences for producing filter-tipped cigarettes 1 have numerous advantages, by enabling filter-tipped cigarettes 1 to be produced quickly (i.e. at a high operating speed comparable with those of modern cigarette manufacturing systems) and cheaply (i.e. with only minor, non-invasive alterations to existing conventional filter assembly machines).

The invention claimed is:

1. A filter-tipped cigarette (1) comprising:
- a tobacco portion (2) having an outer end (3) and an inner end (4);
- a filter (5) butt-connected to the inner end (4) of the tobacco portion (2);
- a first sleeve (6) wound about the tobacco portion (2) and the filter (5) to connect the filter (5) permanently and non-detachably to the tobacco portion (2);
- a first cap (7) butt-connected to the outer end (3) of the tobacco portion (2), at the opposite end from the filter (5), and removable to smoke the filter-tipped cigarette (1); and
- a second sleeve (8), which is wound about the first cap (7) and the tobacco portion (2), is integral with the first cap (7), and is at least partly removable axially from the tobacco portion (2) together with and to remove the first cap (7);
- wherein the second sleeve (8) is glued by a first glue (10) to the first cap (7).

2. A filter-tipped cigarette (1) according to claim 1, wherein the first glue (10) is permanent, drying glue with an adhesive force greater than the mechanical strength of the second sleeve (8), so the second sleeve (8) can only be detached by being torn off the first cap (7).

3. A filter-tipped cigarette (1) according to claim 1, wherein the first cap (7) is made of normal cigarette filter filtering material.

4. A filter-tipped cigarette (1) according to claim 3, wherein the first cap (7) is made of the same filtering material as the filter (5).

5. A filter-tipped cigarette (1) according to claim 1, wherein the first cap (7) is unsuitable for use as a filter, and must be removed to smoke the filter-tipped cigarette (1).

6. A filter-tipped cigarette (1) according to claim 1, wherein the first sleeve (6) and second sleeve (8) are initially joined at an annular tear line (9) allowing the second sleeve (8) to be torn from the first sleeve (6) when the second sleeve (8) is removed axially from the tobacco portion (2) together with and to remove the first cap (7).

7. A filter-tipped cigarette (1) according to claim 1, wherein the second sleeve (8) is independent of the first sleeve (6), and is wound about and superimposed on the first sleeve (6).

8. A filter-tipped cigarette (1) according to claim 7, wherein the second sleeve (8) is glued by a second glue (11) to the first sleeve (6), and has an annular tear line (9) located alongside the second glue (11), between the first cap (7) and the second glue (11).

9. A filter-tipped cigarette (1) according to claim 1, wherein the second sleeve (8) is independent of the first sleeve (6), and is located alongside and a given distance from the first sleeve (6).

10. A filter-tipped cigarette (1) according to claim 9, wherein the second sleeve (8) is glued by a third glue (12) to the tobacco portion (2).

11. A filter-tipped cigarette (1) according to claim 9, wherein the second sleeve (8) has an annular tear line (9), which divides the second sleeve (8) into a movable portion which is removed axially from the tobacco portion (2) together with the first cap (7), and into a fixed portion which is torn off the movable portion when the movable portion is removed axially from the tobacco portion (2) together with the first cap (7).

12. A filter-tipped cigarette (1) according to claim 11, wherein the fixed portion of the second sleeve (8) is glued by a third glue (12) to the tobacco portion (2), and the annular tear line (9) is located alongside the third glue (12), between the first cap (7) and the third glue (12).

13. A filter-tipped cigarette (1) according to claim 1, wherein the first cap (7) has a gripping aid for easy user grip.

14. A filter-tipped cigarette (1) according to claim 1, and comprising a second cap (13), which is located at the opposite end from the first cap (7), rests against an outer end of the filter (5), is removable to smoke the filter-tipped cigarette (1), and is enclosed in the second sleeve (8).

15. A filter-tipped cigarette (1) according to claim 14, wherein the first cap (7) or the second cap (13) has a gripping aid for easy user grip.

16. A filter-tipped cigarette (1) according to claim 1, wherein said first cap (7) and/or said second sleeve (8) are impregnated with an aromatic substance and/or have, graphic marks and/or patterns.

17. A manufacturing method for producing a filter-tipped cigarette (1), the manufacturing method comprising the steps of:
- producing a tobacco portion (2) having an outer end (3) and an inner end (4);
- butt-connecting a filter (5) to the inner end (4) of the tobacco portion (2);
- winding a first sleeve (6) about the tobacco portion (2) and the filter (5) to connect the filter (5) permanently and non-detachably to the tobacco portion (2);
- butt-connecting a cap (7) to the outer end (3) of the tobacco portion (2), so the cap (7) is located at the opposite end from the filter (5) and is removable to smoke the filter-tipped cigarette (1);
- winding a second sleeve (8) about the cap (7) and the tobacco portion (2), so the second sleeve (8) is integral with the cap (7) and at least partly removable axially from the tobacco portion (2) together with and to remove the cap (7); and
- gluing the second sleeve (8) to the cap (7) using a permanent glue (10);
- wherein the first sleeve (6) is wound together and simultaneously with the second sleeve (8).

* * * * *